United States Patent [19]

Wright, Jr.

[11] 4,197,167

[45] Apr. 8, 1980

[54] RECOVERY AND REUSE OF NICKEL ELECTROPLATING BATHS CARRIED AWAY BY WORKPIECES

[75] Inventor: Leslie S. Wright, Jr., Greenfield, Ind.

[73] Assignee: Michael Ladney, Jr., Grosse Pointe Shores, Mich.

[21] Appl. No.: 971,377

[22] Filed: Dec. 20, 1978

[51] Int. Cl.[2] ..... C25D 5/14; C25D 21/18; C25D 21/20

[52] U.S. Cl. ..... 204/40; 204/35 R; 204/49; 204/238; 204/239; 204/DIG. 13

[58] Field of Search ..... 204/DIG. 13, 232, 237, 204/238, 239, 240, 241, 49, 40, 35 R

[56] References Cited

PUBLICATIONS

John L. Eisenmann, Plating and Surface Finishing, pp. 34–38, Nov. 1977.

*Primary Examiner*—G. L. Kaplan

*Attorney, Agent, or Firm*—Barnes, Kisselle, Raisch & Choate

[57] ABSTRACT

A method and apparatus for treating aqueous rinse mixtures containing organic brightener additives having sulfur therein of nickel electroplating processes by adding acid to the rinse mixture, passing the rinse and acid mixture through a carbon filter to remove the brighteners and decrease the sulfur content of the mixture, and adding the filtered mixture to and reusing it in the semi-bright and bright nickel baths of the nickel electroplating process.

16 Claims, 1 Drawing Figure

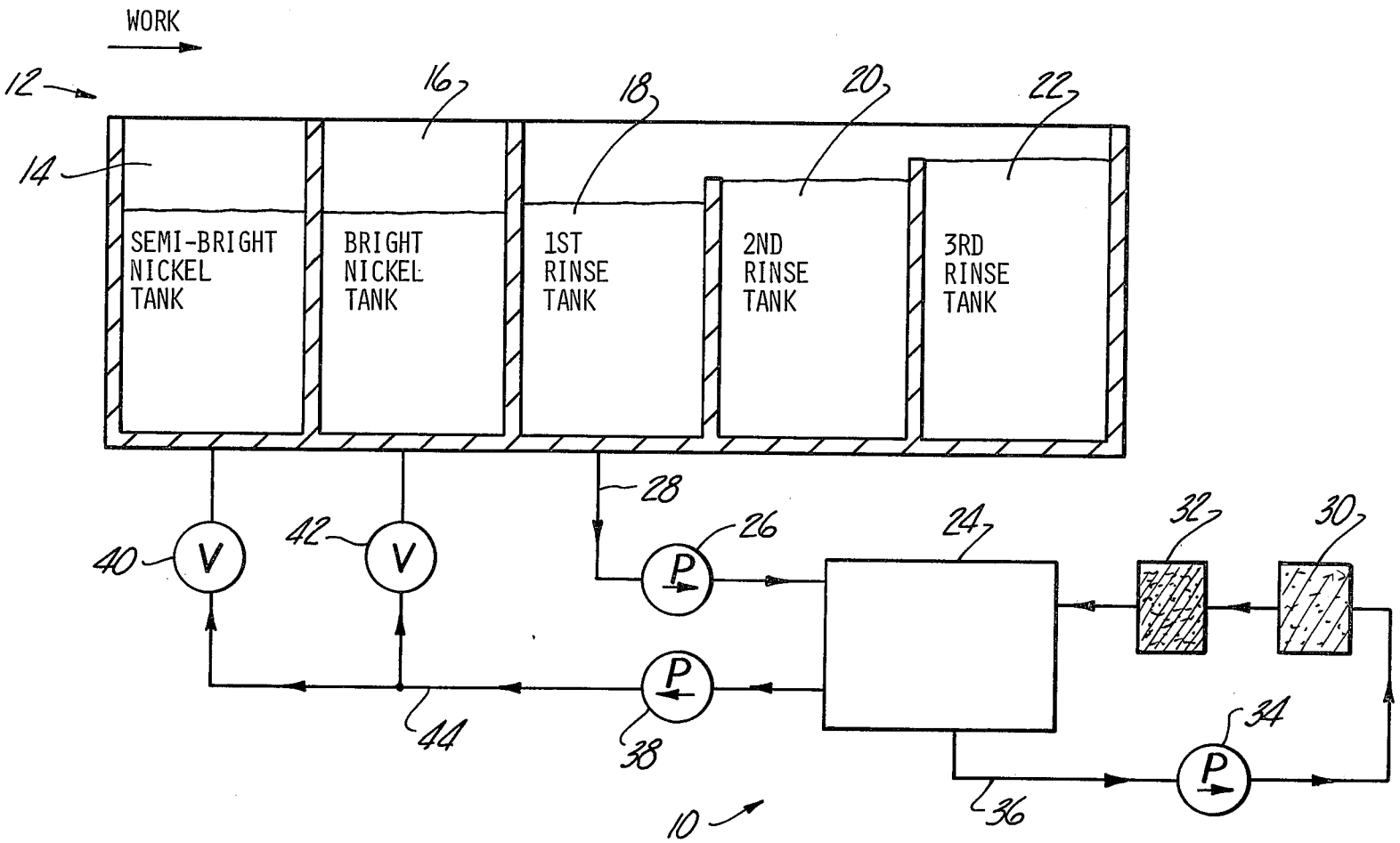
WORK
SEMI-BRIGHT NICKEL TANK
BRIGHT NICKEL TANK
1ST RINSE TANK
2ND RINSE TANK
3RD RINSE TANK
12
14
16
18
20
22
24
26
28
30
32
34
36
38
40
42
44
10
P
P
P
V
V

RECOVERY AND REUSE OF NICKEL ELECTROPLATING BATHS CARRIED AWAY BY WORKPIECES

This invention relates to the electroplating of workpieces and more particularly to the process of and aqueous baths for the electroplating of nickel.

In conventional decorative chrome plating the workpiece is protected from corrosion by a first layer of nickel deposited from a so called semi-bright bath of an aqueous solution of nickel salts. To provide a smooth and lustrous surface on which to deposit the chromium layer an additional overlying layer or layers of nickel are deposited from so called bright baths of an aqueous solution of nickel salts and various brightener additives of organic compounds containing sulfur. After the bright nickel layer or layers are applied to the workpiece it is rinsed in an aqueous mixture to wash away the nickel plating solutions and then a layer of chrome is deposited from a chromium bath on the workpiece over the bright nickel layer to provide a decorative exterior chrome surface.

The nickel salts, such as nickel chloride and nickel sulfate, in the baths of conventional electroplating processes must be periodically replenished and particularly the nickel salts in the semi-bright baths, because as the workpieces are transferred from one bath to another and into the aqueous rinse before deposition of the chromium layer they drag out or carry away with them a portion of the nickel baths. The portion of the nickel baths carried away by the workpieces and remaining in the aqueous rinses is not normally reused in conventional electroplating processes and cannot be reused in a semi-bright nickel bath because it contains so much sulfur from the brightener additives that it would seriously impair the corrosion resistance of the semi-bright nickel layer. Thus the aqueous rinses of conventional electroplating processes are disposed of and usually must be treated to permit safe disposal thereof. Both such treatment of the aqueous rinses and the replacement of the nickel salts in the plating baths are costly.

Objects, features and advantages of this invention are to permit recovery of nickel plating solutions from aqueous rinses and reuse thereof in both semi-bright and bright nickel baths, to substantially decrease and sometimes eliminate the need for treatment and disposal of aqueous rinses containing nickel bath mixtures washed from workpieces, to decrease the quantity of brightener additives needed for nickel electroplating, to decrease the amount of power per workpiece required for nickel electroplating, and to provide a plating process which is more economical, easily carried out, and reliable in use and results in chrome plating of improved quality.

These and other objects, features and advantages of this invention will be apparent from the following detailed description, appended claims, and accompanying diagramatic drawing of a nickel plating line and suitable apparatus for carrying out this invention.

In accordance with this invention in an electroplating process an aqueous rinse containing a nickel bath mixture with organic brightener additives washed from workpieces is treated with an acid and passed through an activated carbon filter to remove the brightener additives and decrease the sulfur content of the mixture, and then the filtered mixture is added to the nickel baths and reused in the nickel electroplating process. Preferably the aqueous rinse from the first rinse tank is treated with acid because this rinse contains a higher concentration of the nickel bath mixture than does the remaining rinses. A sufficient quantity of acid is added to the mixture to be filtered so that the mixture has a pH value of not greater than about 3.0 and preferably a pH value in the range of about 1.5 to 2.5. While the mixture is made filterable at any pH value below 3, pH values below 1.5 require substantial additional quantities of acid and result in a filtered mixture which when added to the plating baths would increase their acidity below their usual pH value of about 3.0 to 4.9 and thus it is believed to be preferable to maintain the pH value of the mixture to be filtered at about 2.0. Since in conventional plating processes the pH value of the nickel baths increases during use thereof the pH value of the filtered mixture added to the baths can be somewhat lower than that of the nickel baths.

It is believed that the addition of the acid to the mixture to be filtered converts by precipitation of sulfur the organic compounds in the brightener additives to a form in which thev can be filtered from the mixture by absorption by the carbon filter. Regardless of the theoretical explanation, it has been found in practice that by adding sufficient acid so that the mixture to be filtered has a pH value not greater than about 3.0 and passing the mixture through a carbon filter will result in a filtered mixture which still contains the nickel salts in solution and has a low enough sulfur content so that the filtered mixture can be added to and reused in both the semi-bright and bright nickel baths of an electroplating process.

Both hydrochloric and sulfuric acid have been found to perform satisfactorily for decreasing the pH value of the aqueous rinse mixture to be filtered. It is believed to be preferable to add both hydrochloric and sulfuric acid to the aqueous rinse mixture to be filtered in about the same proportion or ratio as that of the nickel chloride and nickel sulfate salts used to make up the plating baths which is conventionally about 1 part by weight of nickel chloride to 1 to 10 parts of nickel sulfate.

Since the solutility of sulfur in an aqueous mixture increases with increasing temperature of the mixture, it is preferable that the aqueous rinse and acid mixture be at a temperature not greater than about 100° F. when it passes through the carbon filter. It is also preferable that such mixture be at a temperature of not less than about 70° F. when it passes through the carbon filter because such mixture also contains boric acid from the nickel plating baths which might be precipitated out of the mixture and clog the carbon filter if the temperature of the mixture is substantially below about 70° F. Preferably, although not necessarily, after the acid is added to the aqueous rinse mixture it is passed through a particle filter to remove any precipitate or other particulate matter before passing through the carbon filter. A conventional particle filter such as an ordinary paper filter is satisfactory for removing particulate matter from the mixture. Preferably the carbon filter is of charcoal or activated carbon.

Preferably the filtered mixture is added to the nickel plating baths either at frequent intervals or continuously and at a slow enough rate and in a small enough quantity relative to the volume of the baths so that it does not produce any substantial changes in the concentration of the various chemicals in the baths or of the pH value thereof while the baths are being used in an electroplating process.

The drawing shows in diagramatic form a suitable apparatus 10 in conjunction with a nickel plating line 12 for carrying out the method of this invention. Plating line 12 has a semi-bright nickel tank 14, bright nickel tank 16 and first, second and third rinse tanks 18, 20 and 22 through which each workpiece is successively transferred. The anodes in tanks 14 and 16 are not shown. The nickel plating bath mixture carried away from tanks 14 and 16 by the workpieces is rinsed from the workpieces by aqueous mixtures in rinse tanks 18, 20 and 22 which tanks are arranged so that any overflow of tank 22 flows back into tank 20 and any overflow of tank 20 flows back into tank 18.

Apparatus 10 has a reservoir 24 which is supplied with a portion of the aqueous rinse mixture from tank 18 by a pump 26 and suitable conduits 28. Acid is added to the rinse mixture in reservoir 24 and the rinse and acid mixture is recirculated through a particle filter 30 and a carbon filter 32 by a pump 34 and suitable conduits 36. The filtered rinse and acid mixture in reservoir 24 is supplied to nickel tanks 14 and 16 by a pump 38, control valves 40 and 42, and suitable conduit 44.

Preferably the rinse mixture from tank 18 is supplied to reservoir 24 by pump 26 either continuously or at frequent intervals and at a rate which is equal to the rate of additions to tank 18 of the nickel plating baths from tanks 14 and 16 by the workpieces and the back flow from tank 20 so that the level of the aqueous rinse mixture in tank 18 remains substantially constant. Preferably the filtered rinse and acid mixture from reservoir 24 is supplied to nickel tanks 14 and 16 by pump 38 and valves 40 and 42 either continuously or at frequent intervals and at a rate which is equal to the rate at which the nickel plating baths are removed from tanks 14 and 16 by the workpieces so that the level of the baths within tanks 14 and 16 remains substantially constant and the chemical composition and pH value of the baths is substantially uniform throughout the plating process. To assure that the rinse and acid mixture in reservoir 24 is adequately filtered when it is returned to the baths in tanks 14 and 16, pump 34 preferably recirculates such mixture through filters 30 and 32 at a much higher rate than the rate at which the mixture is removed from the reservoir by pump 38 so that the mixture in the reservoir in effect passes through filters 30 and 32 several times before it is added to the nickel plating baths in tanks 14 and 16.

If desired, suitable apparatus for automatically maintaining the pH value of the mixture within reservoir 24 substantially constant by adding small quantities of acid as needed can be utilized, such as an Automatic pH Controller and supply unit manufactured and sold by Leads & Northrop. Particle filter 30 may be a paper filter or depth cartridge from Summit Scientific of Rutherford, N.J. and carbon filter 32 is preferably of activated carbon such as the Karbo Klear activated carbon impregnated depth filter with 4 ounces of carbon per 10 inch section available from Summit Scientific of Rutherford N.J.

In using plating line 12 tanks 14 and 16 are filled with conventional nickel plating baths having an aqueous solution of about 300 to 550 grams per liter of nickel chloride and nickel sulfate salts and a buffer of about 30 to 40 grams per liter of boric acid. The baths may have a pH value in the range of about 2 to 5 and preferably a pH value of about 3 to 4 and are normally operated at a temperature in the range of about 70° F. to 180° F. and preferably about 130° F. to 150° F. In order to provide plated workpieces with good corrosion resistance the semi-bright bath has a low sulfur content and usually does not contain any organic brightener compounds. The bright nickel bath contains various brightener additives which are organic compounds and at least some of which contain sulfur which results in the bright nickel bath having a substantially higher sulfur content than that of the semi-bright bath. Several suitable brighteners are disclosed in U.S. Pat. No. 3,288,574 and the patents referred to therein. Rinse tanks 18, 20 and 22 contain an aqueous acidic mixture having a pH value in the range of about 1.5 to 2.5 and are normally operated at a temperature in the range of 60° F. to 80° F.

Commercially available nickel plating bath mixtures with which this invention has been successfully used are Perflow and No. 701 semi-bright bath mixtures and Zodiac and Galaxie bright bath mixtures produced by the Harshaw Chemical Company of Cleveland, Ohio, and the N2E semi-bright bath and No. 66 and 724 bright bath mixtures produced by the Udylite Company of Detroit, Mich.

In utilizing apparatus 10 with a plating line 12 a portion of the aqueous mixture in rinse tank 18 is withdrawn at a slow rate by pump 26 and supplied to reservoir 24 where it is mixed with a sufficient quantity of hydrochloric and/or sulfuric acid to maintain the pH value of the mixture within the reservoir at not greater than 3.0 and preferably in the range of 2.0 to 2.5. The rinse and acid mixture in reservoir 24 is recirculated by pump 34 so that it passes through filters 30 and 32 and is returned to tank 24 several times thereby assuring that the mixture in reservoir 24 is adequately filtered. Filter 30 removes particulate particles from the mixture and filter 32 removes the organic brighteners from the mixture by absportion so that it can be returned to and used in both the semi-bright and bright nickel baths in tanks 14 and 16. Additional nickel salts are added as needed to the semi-bright bath in tank 14 and additional brightener additives are added as needed to the bright nickel bath in tank 16 just as in conventional electroplating processes.

Using apparatus 10 to carry out the process of this invention with a conventional nickel plating line to plate metal or plastic workpieces with a semi-bright nickel layer 0.0005 of an inch thick and bright nickel layer 0.003 of an inch thick with a surface area of about 20 square feet at the rate of about 100 workpieces per hour has proved to be highly satisfactory. The semi-bright bath contained about 32 oz. per gal. $NiSO_4$, 6 oz. per gal. $NiCl_2$, and 7 oz. per gal. boric acid with the mixture having a pH value of about 3.2, and the bright plating bath contained about 32 oz. per gal. $NiSO_4$, 10 oz. per gal. $NiCl_2$, and 7 oz. per gal. boric acid with the mixture having a pH value of about 3.6. The nickel plating baths were at a temperature of about 145° F. and the first aqueous rinse was at a temperature of about 80° F. In the semi-bright bath the workpieces were subjected to a potential of about 7 volts and a current of about 40 amps per square foot, and in the bright nickel tank the workpieces were subjected to a potential of about 7 volts and a current of about 50 amps per square foot. Apparatus 10 supplied mixture from the first rinse tank to the reservoir 24 substantially continuously at a rate of about 200 gallons per hour, recirculated the mixture in reservoir 24 through filters 30 and 32 at the rate of about 200 gallons per hour, and supplied filtered mixture from reservoir 24 to the semi-bright nickel bath in tank 40 at about 75 gallons per hour and to the bright nickel bath in tank 42 at about 30 gallons per hour. Reservoir 24 had a capacity of about 3,000 gallons and sufficient acid was added to the mixture in the reservoir as needed to maintain the pH value of the mixture in the range of about 1.5 to 2.5 with an average value of about 2.0.

Such use of the process of this invention has resulted in substantial cost savings due to the greatly decreased amount of waste nickel plating baths and rinse water which must be treated for disposal and the decrease in the amount of nickel salts and brightener additives consumed by the plating process. With the use of this process it has become economically feasible to increase the concentration of nickel salts in the plating baths which has resulted in improved quality of nickel plating, a decrease in the quantity of brightener additives, and a decrease in the amount of power required to produce a given thickness of nickel plating on a workpiece. By returning the filtered mixture to the nickel plating bath in small quantities and in at least frequent intervals the variation in the chemical composition and the pH value of the baths during plating operations is believed to have been substantially decreased which is believed to result in more consistent and reliable plating operations which produce plated workpieces of improved quality.

I claim:

1. In an electroplating process wherein workpieces sequentially pass through at least one semi-bright nickel electroplating bath, at least one bright nickel electroplating bath having therein organic brightener additives containing sulfur, and at least one aqueous rinse which washes from the workpieces at least part of the bright nickel plating bath carried away by the workpieces such that the aqueous rinse contains sufficient sulfur bearing brightener additives that it would impair the effectiveness of the semi-bright nickel plating bath if added directly thereto, the method of treating the aqueous rinse which comprises adding a sufficient quantity of acid to the aqueous rinse to decrease its pH value to not more than 3.0, passing the aqueous rinse and acid mixture through a carbon filter and thereby removing at least a sufficient portion of the brightener additives from the mixture and sufficiently decreasing the sulfur content of the mixture such that the filtered mixture can be added to and reused in a nickel electroplating bath.

2. The method of claim 1 wherein sufficient acid is added to the aqueous rinse to lower the pH of the resulting aqueous rinse and acid mixture to a value in the range of 1.5 to 2.5.

3. The method of claim 1 wherein the acid added to the aqueous rinse is selected from a group consisting of hydrochloric and sulfuric acid.

4. The method of claim 1 wherein the aqueous rinse and acid mixture is recirculated through the carbon filter a plurality of times before the filtered mixture is added to a nickel electroplating bath.

5. The method of claim 1 which also comprises passing the aqueous rinse and acid mixture through a particle filter before such mixture is passed through the carbon filter.

6. The method of claim 1 wherein the temperature of the aqueous rinse and acid mixture is not greater than about 100 degrees Fahrenheit when such mixture is passed through the carbon filter.

7. The method of claim 1 wherein the temperature of the aqueous rinse and acid mixture is in the range of about 70 to 100 degrees Fahrenheit when such mixture is passed through the carbon filter.

8. The method of claim 1 wherein the filtered mixture is added to a semi-bright nickel electroplating bath of an electroplating process.

9. The method of claim 1 wherein the filtered mixture is added to both a semi-bright nickel electroplating bath and a bright nickel electroplating bath of the same electroplating process.

10. The method of claim 1 wherein the filtered mixture is added at least frequently to and in relatively small quantities in relation to the quantity of a nickel plating bath substantially throughout the period of time during which such bath is actually being used in an electroplating process.

11. The method of claim 1 wherein the filtered mixture is added at least substantially continuously to the nickel electroplating bath.

12. The method of claim 11 wherein the filtered mixture is added to a semi-bright nickel electroplating bath.

13. The method of claim 11 wherein the filtered mixture is added to a bright nickel electroplating bath.

14. The method of claim 11 wherein the filtered mixture is added to both a semi-bright nickel electroplating bath and a bright nickel electroplating bath of the same electroplating process.

15. The method of claim 1 wherein the acid added to the aqueous rinse comprises hydrochloric acid or sulfuric acid.

16. The method of claim 1 wherein the acid added to the aqueous rinse consists essentially of hydrochloric acid or sulfuric acid.

* * * * *

UNITED STATES PATENT AND TRADEMARK OFFICE

CERTIFICATE OF CORRECTION

PATENT NO. : 4,197,167

DATED : April 8, 1980

INVENTOR(S) : Leslie S. Wright, Jr.

It is certified that error appears in the above-identified patent and that said Letters Patent are hereby corrected as shown below:

In Column 2, line 11, delete "4.9" and insert -- 4.0 --.

Signed and Sealed this

*Twenty-second* Day of *July 1980*

[SEAL]

*Attest:*

SIDNEY A. DIAMOND

*Attesting Officer*

*Commissioner of Patents and Trademarks*